United States Patent [19]

Koenig et al.

[11] 4,029,471

[45] June 14, 1977

[54] PROCESS FOR SIMULTANEOUSLY FLAMEPROOFING AND SHRINKPROOFING WOOL

[75] Inventors: Nathan H. Koenig, Albany; Mendel Friedman, Moraga, both of Calif.

[73] Assignee: The United States of America, as represented by the Secretary of Agriculture, Washington, D.C.

[22] Filed: Apr. 14, 1976

[21] Appl. No.: 676,948

[52] U.S. Cl. ..... 8/128 R

[51] Int. Cl.[2] ..... D06M 13/20; D06M 13/42

[58] Field of Search ..... 8/128R

[56] References Cited

UNITED STATES PATENTS

| | | | |
|---|---|---|---|
| 3,156,522 | 11/1964 | Koenig | 8/127.6 |
| 3,332,733 | 7/1967 | Koenig | 8/128 |
| 3,357,785 | 12/1967 | Garber et al. | 8/128 |

*Primary Examiner*—John Kight, III

*Attorney, Agent, or Firm*—M. Howard Silverstein; David G. McConnell

[57] ABSTRACT

Wool is flameproofed and shrinkproofed by a process wherein the wool is reacted simultaneously with a halogenated acid anhydride and an isocyanate in the presence of cresol. The flameproofing treatment is durable to both aqueous laundering and drycleaning.

3 Claims, No Drawings

PROCESS FOR SIMULTANEOUSLY FLAMEPROOFING AND SHRINKPROOFING WOOL

BACKGROUND OF THE INVENTION

This invention relates broadly to the chemical modification of wool by reacting it simultaneously with a halogenated acid anhydride and an isocyanate. In particular, the invention concerns and has as its prime object the provision of processes wherein the reaction of wool with the above reagents is conducted in the presence of cresol, whereby to facilitate and promote the reaction. The unqualified term "cresol" used herein includes o-cresol, m-cresol, p-cresol, or any mixture of these isomers. Further objects and advantages of the invention will be apparent from the following description wherein parts and percentages are by weight, unless otherwise specified.

Although wool is a very useful fiber, it is often desirable to improve its properties for particular applications by chemically modifying it. Previously, wool has been shrinkproofed with isocyanates, but the product is not flameproof. Furthermore, wool has been flameproofed with halogenated acid anhydrides, but the product does not meet consumer requirements for shrinkproofing.

Wool which is both shrinkproof and flameproof has also been prepared. However, a two-step process is required——the wool is first shrinkproofed and then flameproofed. The two-step process has the disadvantage of being less efficient and economical than a one-step process.

SUMMARY OF THE INVENTION

The invention described herein obviates the above problem. In accordance with the present invention, wool is reacted simultaneously with a halogenated acid anhydride and an isocyanate in the presence of cresol. The latter compound catalyzes the actual chemical combination of the wool and the other reactants. As a consequence, one is enabled to readily prepare wools containing substantial proportions of combined acid anhydride and isocyanate with correspondingly improved properties.

It should be noted that the success of the simultaneous feature of the instant invention is a quite unexpected result. The reaction of wool with certain acid anhydrides in cresol is known, having been described by Koenig, U.S. Pat. No. 3,332,733, July 25, 1967. However, the inclusion of another chemical modifying agent in the process of the above-mentioned patent would be expected only to either inhibit or prevent the intended reaction. Surprisingly, however, when the above reactants are combined in cresol and reacted simultaneously with wool, substantial modification of the wool results due to the actual chemical combination of the wool with both the acid anhydride and the isocyanate. The result is a flameproofed and shrinkproofed product, and the effectiveness of the combined treatment is much greater than if either reagent is used alone.

One advantage of the instant process is that it is efficient and economical. A one-step process is less expensive to carry out than a two-step process.

A further advantage of the invention is that the modified wool retains its improved properties even after aqueous launderings. It should be noted further than the wool modified in accordance with the invention also retains its improved properties when subjected to normal dry-cleaning.

DETAILED DESCRIPTION OF THE INVENTION

Carrying out the process of the invention essentially involves contacting wool with a halogenated acid anhydride and an isocyanate in the presence of cresol. The reaction conditions such as specific acid anhydride and isocyanate used, proportion of reagents, time, temperature, etc., are not critical but may be varied to suit individual circumstances without changing the basic nature of the invention. The proportion of cresol may be varied widely and may be as low as 0.3–0.5 parts per part of wool. Usually, it is preferred to use a larger proportion of cresol, i.e., about 2 to 6 parts per part of wool, to attain an increased catalytic effect.

The temperature of reaction may be about from 50° to 200° C. The reaction rate is increased with increasing temperature and a suitable temperature range to expedite the reaction without damage to the wool is 100°–120° C. In commercial practice shorter reaction times are possible by employing temperatures up to 200° C., provided the time of contact between the wool and the solvent is such that damage to the fiber is avoided.

It is preferred to carry out the reaction under anhydrous conditions, thereby to ensure reaction between the wool, acid anhydride, and isocyanate but the reaction can also be applied to wool in its normal undried condition (containing about 12–14% water). The degree of modification of the wool is related to the proportion of reactants taken up by the fiber, that is, the higher the uptake of acid anhydride and isocyanate, the greater will be the flameproof and shrinkproof nature of the wool. In general, about 0.1 to 0.5 parts of each reactant is used per part of wool. The time of reaction will vary depending on the temperature of reaction, reactivity of the reagents, proportion of cresol, and the degree of modification desired. In general, the reaction may take anywhere from a few minutes to several hours.

The process in accordance with the invention may be carried out in various ways. For example, the wool may be directly contacted with a mixture of acid anhydride, isocyanate and cresol, and the reaction mixture preferably heated as indicated above to cause the reagents to react with the wool. In the alternative, the wool may be pretreated (padded) with either hot or cold cresol. The wool can then be brought in contact with a mixture of acid anhydride and isocyanate and heated to complete the reaction.

After reaction of the wool with the reagents, the chemically modified wool is preferably treated to remove excess reactants, reaction by-products, and cresol. Thus, the wool may be treated as by wringing, passage through squeeze-rolls, centrifugation, or the like, to remove the excess materials. In place of such mechanical action, or following it, the product may be extracted with an inert, volatile solvent such as trichloroethylene, benzene, acetone, carbon tetrachloride, alcohol, etc. Successive extractions with different solvents may be used to ensure complete removal of all unreacted materials. The treated wool is then dried in the usual way.

By treating wool with an acid anhydride and an isocyanate as herein described, the wool is chemically modified because there is a chemical reaction between the above reactants and the protein molecules of the wool fibers.

Although the properties of the modified wool indicate beyond question that actual chemical combination between the wool and the reactants has taken place, it is not known for certain how the wool and these reactants are joined. It is believed, however, that the reagents react with some of the sites on the wool molecule where there are reactive hydrogen atoms, e.g., amino, guanidino, hydroxyl, and phenolic groups. A possible explanation for the effectiveness of the combined treatment is that acylation of the wool by the acid anhydride forms carboxyl groups that swell the wool structure and provide additional sites of reaction for the isocyanate. This effect cannot operate when wool is treated with either agent alone. It may be, however, that other reactions occur and it is not intended to limit the invention to any theoretical basis.

When the reaction is carried out with a diisocyanate, for example, tolylene-2,4-diisocyanate, combination with the wool may establish cross-links between protein molecules that may increase the resistance of the wool to attack by chemicals, carpet beetles, moths, and the like. The presene of halogen introduced by the halogenated acid anhydride may also be beneficial in improving resistance to attack by insects.

The tendency of wool to shrink when subjected to washing in aqueous media has long been a deterrent to the more widespread use of wool. An important advantage of the invention is that it yields modified wools which have a decreased tendency to shrink when subjected to washing with conventional soap and water or detergent and water formulations.

Although wool does not ignite readily, flames will propagate in wool once ignition has occurred. A need, therefore, exists to flameproof wool for many uses such as airplane upholstery, carpeting, blankets, sleepwear, and the like. The invention described herein fulfills this need.

Another advantage of the invention is that the improvement is essentially permanent, unlike some surface treatments. The treated materials do not lose their new properties after long use or wear, but retain these properties for the life of the material.

It is to be noted that the reaction in accordance with the invention does not impair the wool fiber for its intended purpose, that is, for producing woven or knitted textiles, garments, etc. The process of the invention may be applied to wool in the form of fibers, as such, or in the form of threads, yarns, slivers, rovings, knitted or woven goods, felts, etc. The wool textiles may be white or dyed goods and may be of all-wool composition or blends of wool with other textile fibers, such as cotton, regenerated cellulose, animal hair, etc.

Acid anhydrides to be used in the process of the invention must be chosen for their ability to flameproof the treated material. Various halogenated acid anhydrides may be employed, such as tetrachlorophthalic anhydride, tetrabromophthalic anhydride, chlorendic anhydride, chloroacetic anhydride, dichloroacetic anhydride, dichlorosuccinic anhydride, tetrachlorosuccinic anhydride, dichloromaleic anhydride, and the like.

Isocyanates which may be used in accordance with the invention to produce a shrinkproof product include tolylene diisocyanate, xylylene diisocyanate, phenylene diisocyanate, cyclohexyl diisocyanate, 4,4'-diphenylmethane diisocyanate, 4,4'-dicyclohexylmethane diisocyanate, dianisidine diisocyanate, hexamethylene diisocyanate, phenyl isocyanate, chlorophenyl isocyanate, dichlorophenyl isocyanate, bromophenyl isocyanate, tetrabromophenyl isocyanate, octadecyl isocyanate, isophorone diisocyanate, 1-isocyanato-3,3,5-trimethyl-5-isocyanatomethylcyclohexane, dimer oleic acid diisocyanate, etc.

DESCRIPTION OF THE PREFERRED EMBODIMENTS

The invention is further demonstrated by the following illustrative examples.

The wool used in the experiments set forth below was undyed wool flannel, 6.5 oz./square yd., cut into circles (8 cm. in diameter) or swatches (5 × 10 in.). These samples were exhaustively extracted with trichloroethylene followed by ethanol, then oven-dried and weighed. All weight increases are given on a dry wool basis.

Flame tests were carried out according to a modified AATCC 34–1969 procedure published in AATCC Technical Manual, Vol. 48, pages 201–202 (1972). Specimens (2.5 × 9.5 in.), conditioned at 70° F., 65% RH, were exposed to a flame for 12 seconds. Treatment is considered effective when the average char length is less than 7 inches, and the after-flame persists less than 12 seconds on the average after removal of the source.

Shrinkage tests were conducted on the circles of fabric as follows: Measured fabric samples, including an untreated wool control, were violently agitated in an "Accelerotor" at 1,780 rpm for 2 minutes at 39°–40° C. with 200 ml. of 0.5% aqueous sodium oleate solution. After this laundering operation, the samples were remeasured to determine area shrinkage.

The swatches were measured after conditioning, and household aqueous laundering tests were conducted in a reversing, agitator-type, household washing machine, using a 3-lb. load, a water temperature of 105° F., and a low-sudsing detergent in a concentration of 0.1 percent in the wash liquor. The wash cycle itself was for 75 minutes, followed by the usual rinses and spin-drying. The damp material was press-dried, conditioned, and re-measured to determine the extent of shrinkage.

EXAMPLE 1

Run A: Circular samples of dried wool fabric (1.2 g.), tetrabromophthalic anhydride (TBPA, 0.5 g.) tolylene-2,4-diisocyanate (TDI, 0.3 ml.), and m-cresol (3.0 ml.) were placed in a Petri dish and heated in an oven at 120° C. for 20 minutes.

The treated wool was extracted with hot ethanol to remove unreacted reagents and then was dried. The weight increase was determined and shrinkage tests were conducted in an "Accelerotor."

The above procedure was repeated on other samples of dried wool fabric with the following changes in the reaction parameters:

Run B: temperature, 180° C.; time, 5 minutes.

Run C: temperature, 180° C.; time, 5 minutes; amount of TBPA, 0.4 g.; amount of TDI, 0.1 ml.

For purposes of comparison the following changes were made in the procedure described for Run C:

Run D: TBPA was omitted.

Run E: TDI was omitted.

As a Control, untreated wool was examined. It should be obvious that Runs D and E are not illustrative of the invention.

The results of all the experiments are tabulated below:

| Run | Temperature (° C.) | Time (min.) | TBPA (g.) | TDI (ml.) | Weight increase (%) | Area shrinkage (%) |
|---|---|---|---|---|---|---|
| A | 120 | 20 | 0.5 | 0.3 | 24 | 0 |
| B | 180 | 5 | 0.5 | 0.3 | 23 | 0 |
| C | 180 | 5 | 0.4 | 0.1 | 18 | 4 |
| D | 180 | 5 | 0 | 0.1 | 1 | 36 |
| E | 180 | 5 | 0.4 | 0 | 14 | 15 |
| Control | | Untreated wool | | | | 42 |

A comparison of Runs C, D, and E indicates that the process of the invention (Run C) yields greater shrinkproofing than the individual use of the agents as evidenced in Runs D and E.

EXAMPLE 2

A dry wool swatch, TBPA (2.0 g.), TDI (0.5 ml.), and m-cresol (15.0 ml.) were placed in an enameled tray. The sample was heated in an oven at 180° C. for 15 min. The modified wool was extracted with hot ethanol and then dried.

The so-treated sample (A) was treated to determine the extent of shrinkage after laundering in a household washing machine. An untreated wool sample was examined as a control. The results are summarized below:

| Sample | Reactants | Weight increase (%) | Area shrinkage (%) |
|---|---|---|---|
| A | TBPA and TDI | 24 | 0 |
| Control | None | None | 43 |

EXAMPLE 3

A sample (B) of wool modified in accordance with the procedure outlined in Example 2 was tested for flame resistance subsequent to laundering as described in Example 2. Untreated wool was examined as a control. The results are summarized below:

| Sample | Reactants | After flame (sec.) | Char length (in.) |
|---|---|---|---|
| B | TBPA and TDI | 0.9 | 3.6 |
| Control | None | 26.7 | Totally burned |

Having thus described our invention, we claim:

1. A process for preparing flameproof and shrinkproof wool by simultaneously reacting the wool with a halogenated acid anhydride and an isocyanate in the presence of cresol.

2. The process of claim 1 wherein the temperature of the reaction is about from 50°–200° C.

3. The process of claim 1 wherein the halogenated acid anhydride is tetrabromophthalic anhydride and the isocyanate is tolylene-2,4-diisocyanate.

* * * * *